US012383841B2

(12) United States Patent
Jung

(10) Patent No.: US 12,383,841 B2
(45) Date of Patent: Aug. 12, 2025

(54) FLEXIBLE MANNEQUIN SHOES AND METHOD FOR MANUFACTURING SAME

(71) Applicant: Hyunju Jung, Seoul (KR)

(72) Inventor: Hyunju Jung, Seoul (KR)

( * ) Notice: Subject to any disclaimer, the term of this patent is extended or adjusted under 35 U.S.C. 154(b) by 169 days.

(21) Appl. No.: 17/276,444

(22) PCT Filed: Sep. 17, 2019

(86) PCT No.: PCT/KR2019/012007

§ 371 (c)(1),
(2) Date: Mar. 15, 2021

(87) PCT Pub. No.: WO2020/060162

PCT Pub. Date: Mar. 26, 2020

(65) Prior Publication Data

US 2022/0039509 A1 Feb. 10, 2022

(30) Foreign Application Priority Data

Sep. 19, 2018 (KR) ..... 10-2018-0112357

(51) Int. Cl.
*A43B 3/24* (2006.01)
*A43B 3/26* (2006.01)
*A63H 3/52* (2022.01)

(52) U.S. Cl.
CPC ..... *A63H 3/52* (2013.01); *A43B 3/244* (2013.01); *A43B 3/248* (2013.01); *A43B 3/26* (2013.01)

(58) Field of Classification Search
CPC ..... A43B 3/06; A43B 3/242; A43B 3/244; A43B 3/248; A43B 3/26; A43B 3/30; A63H 3/52
USPC ..... 36/112
See application file for complete search history.

(56) References Cited

U.S. PATENT DOCUMENTS 2,780,013 A * 2/1957 Voss ..... A43B 3/128 36/105
4,944,099 A * 7/1990 Davis ..... A43B 3/26 36/97
6,023,859 A * 2/2000 Burke ..... A43B 3/0047 36/105

(Continued)

FOREIGN PATENT DOCUMENTS

CN 202890666 U 4/2013
CN 106954905 A 7/2017

(Continued)

*Primary Examiner* — Sharon M Prange
(74) *Attorney, Agent, or Firm* — KORUS Patent, LLC; Seong Il Jeong

(57) ABSTRACT

Proposed are flexible mannequin shoes and a method for manufacturing same. The flexible mannequin shoes of the present invention are characterized by comprising: a front guide member having a structure for surrounding a toe portion of a mannequin foot; a rear guide member having a structure for surrounding a heel portion of the mannequin foot; and a cover member having a structure for covering portions including the front guide member and the rear guide member which are inserted over the mannequin foot. According to the present invention, the practical effect of making the flexible mannequin shoes look like real shoes when viewed from the outside can be provided, and the shoes can be worn on various shoes and new mannequin feet by changing the cover member and the guide member.

13 Claims, 13 Drawing Sheets

(56) References Cited

U.S. PATENT DOCUMENTS

| | | | | |
|---|---|---|---|---|
| 6,233,846 | B1 * | 5/2001 | Sordi | A43B 5/12 36/105 |
| 6,920,707 | B1 * | 7/2005 | Greene | A43B 13/16 36/97 |
| 8,240,067 | B2 * | 8/2012 | Sussmann | A43B 3/24 36/31 |
| 10,813,404 | B2 * | 10/2020 | Orza | A43B 5/12 |
| 2001/0005947 | A1 * | 7/2001 | Sordi | A43B 13/141 36/31 |
| 2006/0130364 | A1 * | 6/2006 | Greene | A43B 7/1425 36/15 |
| 2008/0034613 | A1 * | 2/2008 | Wilkenfeld | A43B 13/16 36/102 |
| 2014/0090274 | A1 * | 4/2014 | Arquilla | A43B 13/14 36/43 |
| 2014/0223770 | A1 * | 8/2014 | Fallow | A43B 5/12 36/83 |
| 2015/0157087 | A1 | 6/2015 | Blumenthal et al. | |
| 2017/0303627 | A1 * | 10/2017 | Weidl | A43B 5/185 |

FOREIGN PATENT DOCUMENTS

| | | | |
|---|---|---|---|
| JP | 2000-037203 | A | 2/2000 |
| KR | 10-2011-0136507 | A | 12/2011 |
| KR | 10-2014-0089029 | A | 7/2014 |
| KR | 10-1489561 | B1 | 2/2015 |
| WO | 2016/113082 | A1 | 7/2016 |

* cited by examiner (a)

(b)

FLEXIBLE MANNEQUIN SHOES AND METHOD FOR MANUFACTURING SAME

TECHNICAL FIELD

The invention relates to a flexible mannequin shoes and a method for manufacturing the same, and more particularly, to a shoe of a flexible structure for a mannequin, in which a shape of the shoe can be conveniently adjusted on the spot according to a mannequin's foot, as well as providing a practical effect of being seen as an actual shoe from the outside, and a manufacturing method thereof.

BACKGROUND ART

In general, a mannequin is a life-sized doll to display or fit clothing or fashion accessories in a show window, thereby inducing customers to buy the items.

In the case of demonstrating fashions, such as dresses or suits, for customers, a mannequin which is similar to a human body but has an ideal figure is used in shop windows to help the fashions.

The shape of the mannequin varies according to manufacturers, poses of mannequins, and trends. Since tight-fitting shoes of a human are not easy to put on feet of the fixed solid mannequin while being matched with the new clothing, there is needed a mannequin's shoe which is suitable for the mannequin's foot needed.

The mannequin generally includes a weight base fixed to a lower end of the mannequin to keep the mannequin in a standing state, so that the mannequin is supported and stood up by the base.

The conventional mannequin has a structure at a bottom surface of a sole to receive a support provided on the base. In this instance, since a lower portion of the sole of one shoe should be penetrated, the shoe is no longer reutilized for human. However, such a mannequin has an advantage of minimizing the exposure of the support.

As illustrated in FIG. 1, in order to install a mannequin 1 to a base 2, a support 3 is vertically fixed to a desired portion of the base 2, and a bracket 4 having a coupling tube 5 is inserted into and fixed to one foot of the mannequin 1 by screws, so that the mannequin 1 is supported in a standing state by inserting and engaging the support 3 to the coupling tube 5. In this instance, the base 2 is made of a weight, such as metal, to prevent the mannequin from easily falling down or swinging.

If the shoe which is put on the foot of the mannequin is in harmony with the clothing worn by the mannequin, it can arouse customer's esthetic sense, which exerts an effect on purchasing desire. Therefore, such a mannequin can improve an effect of exhibition.

One example of such a shoe for the mannequin is disclosed in Korean Patent No. 10-1489561, in which the shoe includes a flange member having a penetration hole or a cutting line for forming a penetration hole, and formed in a closed curve line, a protrusion member extended upward from one side of an upper surface of the flange member, a cover member formed corresponding to a shape of the flange member to be coupled to the upper surface of the flange member, and having a through-hole through which the protrusion member passes, a locking member coupled to the protrusion member and wrapping at least one of the top of the foot and the heel, and a protrusion member coupled to a lower portion of a rear surface of the flange member.

The shoe of the above patent should replace a new locking member or protrusion member so as to replace the locking member or the heel. Therefore, there is a limit to reduce a cost and time required for replacing the shoe of the mannequin, in view of wages and production prices of a material to manufacture the locking member or the protrusion member.

Also, a fashion market needs a shoe for a mannequin capable of easily representing various shoe designs, as well as being inexpensive.

Accordingly, a shoe for a mannequin is needed to reduce production costs of the shoe, simplify a process of replacing the shoe, and shorten a replacing time.

DISCLOSURE

Technical Problem

Accordingly, one object of the invention is to provide a flexible shoe for a mannequin that is configured to provide a practical effect of being seen as an actual shoe from the outside, reduce costs for manufacturing the shoe which is frequently replaced according to weather or trend, and shorten a time for replacing the shoe, as well as being able to be adjusted in various ways, and a manufacturing method thereof.

Technical Solution

To accomplish the above-mentioned object, according to one aspect of the invention, there is provided a flexible shoe for a mannequin, including: a front guide member configured to receive and cover a toe portion of a mannequin's foot; a rear guide member configured to receive and cover a heel portion of the mannequin's foot; and a cover member configured to cover the mannequin's foot which is inserted into the front guide member and the rear guide member.

According to one embodiment of the invention, the flexible shoe for the mannequin further includes a bottom surface guide member that has a structure corresponding to the front guide member and the rear guide member that receive the mannequin's foot, and is detachably mounted on a bottom surface of the cover member.

According to one embodiment of the invention, the flexible shoe for the mannequin further includes a protrusion member that has a structure corresponding to the front guide member and the rear guide member that receive the mannequin's foot, and is detachably mounted on a bottom surface of the cover member, the protrusion member being extended downwardly by a given length.

According to one embodiment of the invention, the front guide member and the rear guide member are made or one or plastic materials, silicone materials, Hanji (Korean traditional paper) paste materials, paper materials, fabric materials, and non-woven fabric materials, or a combination thereof.

According to one embodiment of the invention, a circumferential adjusting structure is formed on a top surface or a bottom surface of the front guide member to adjust a circumference of the front guide member.

According to one embodiment of the invention, the circumferential adjusting structure has a structure that is cut by a given length along one side of the front guide member, and a structure that is recessed by a given depth along one side of the front guide member.

According to one embodiment of the invention, the rear guide member is fixed to a heel portion of the mannequin's foot and a portion corresponding to the heel portion by an attaching member.

According to one embodiment of the invention, the cover member is made of materials having a given elastic restoring force so that the cover member is elastically deformed according to shapes of the front guide member, the rear guide member and the mannequin's foot.

According to one embodiment of the invention, an upper portion of the cover member is opened to form an opening that receives the mannequin's foot.

According to one embodiment of the invention, a bottom surface of the cover member is provided with a through-hole that a bottom surface of the mannequin's foot receives a support through.

According to one embodiment of the invention, the cover member includes a coupling line formed on a bottom surface thereof.

According to one embodiment of the invention, a surface of the cover member is provided with a pattern indicating presence of a sewn stitch or accessary.

According to one embodiment of the invention, a lower portion of the protrusion member is detachably attached by an attaching member to a base at a position corresponding to the lower portion of the protruding member.

According to one embodiment of the invention, the protrusion member is interposed between an upper portion of a base and a lower portion of a shoe put on the mannequin's foot.

According to another aspect of the invention, there is provided a method for manufacturing a flexible shoe for a mannequin, the method including: a mould preparing step of preparing separated moulds to form a shoe for a mannequin's foot; a front guide member forming step of placing forming materials over a toe portion of the moulds to form a front guide member that is configured to adjust a circumference thereof, and separating the moulds; a rear guide member forming step of placing the forming material over a heel portion of the moulds to form a rear guide member that is configured to adjust a space thereof, and separating the moulds; a front guide member mounting step for mounting the formed front guide member on the mannequin's foot; a rear guide member mounting step for mounting the formed rear guide member on the mannequin's foot; and a cover member mounting step of covering the mannequin's foot that the front guide member and the rear guide member are mounted on by a cover member.

According to one embodiment of the invention, the method for manufacturing the flexible shoe for the mannequin further includes a protrusion member mounting step of mounting a protrusion member to a lower portion of the cover member.

Advantageous Effects

As described above, the flexible shoe for the mannequin according to the invention is configured to provide a practical effect of being seen as an actual shoe from the outside, reduce costs for manufacturing the shoe which is frequently replaced according to weather or trend, and shorten a time for replacing the shoe, as well as being able to be adjusted in various ways.

MODE FOR INVENTION

Hereinafter, preferred embodiments of the invention will be described in detail in conjunction with the accompanying drawings. The terminologies used herein are for the purpose of describing particular embodiments only and are not intended to limit the right scope of the invention.

In the following description, the phrase "one member is positioned on the other member" includes a case where another member is interposed between two members, as well as a case where two members are directly connected to each other. The terms "comprising" and/or "including" in this specification and the claims are used in an open-ended fashion. When a portion "comprises" and/or "includes" an element, it does not mean to preclude the presence or addition of one or more other elements and/or components unless the context clearly indicates otherwise.

Figure 2:
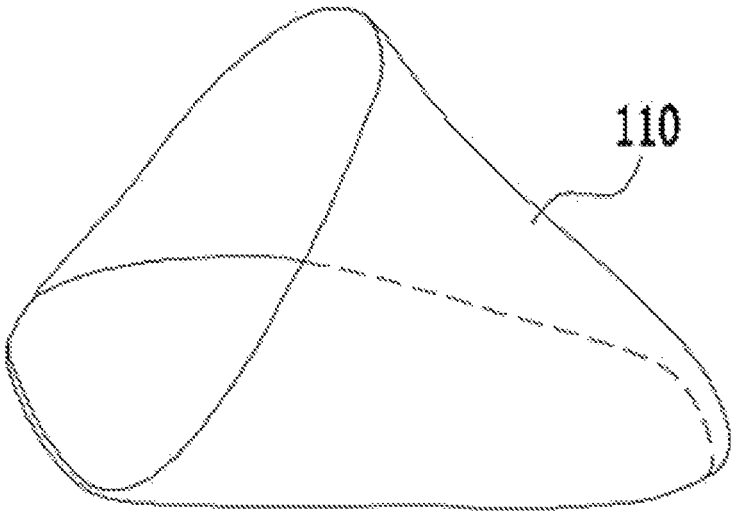
FIG. 2 are perspective views illustrating a front guide member and a rear guide member of a flexible shoe for a mannequin according one embodiment of the invention.
Figure 2:
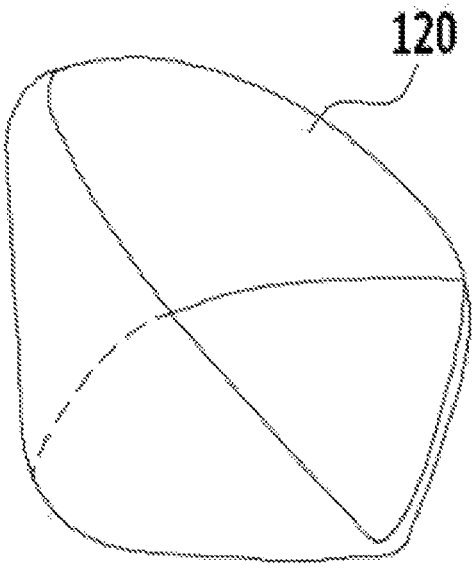
Figure 3:
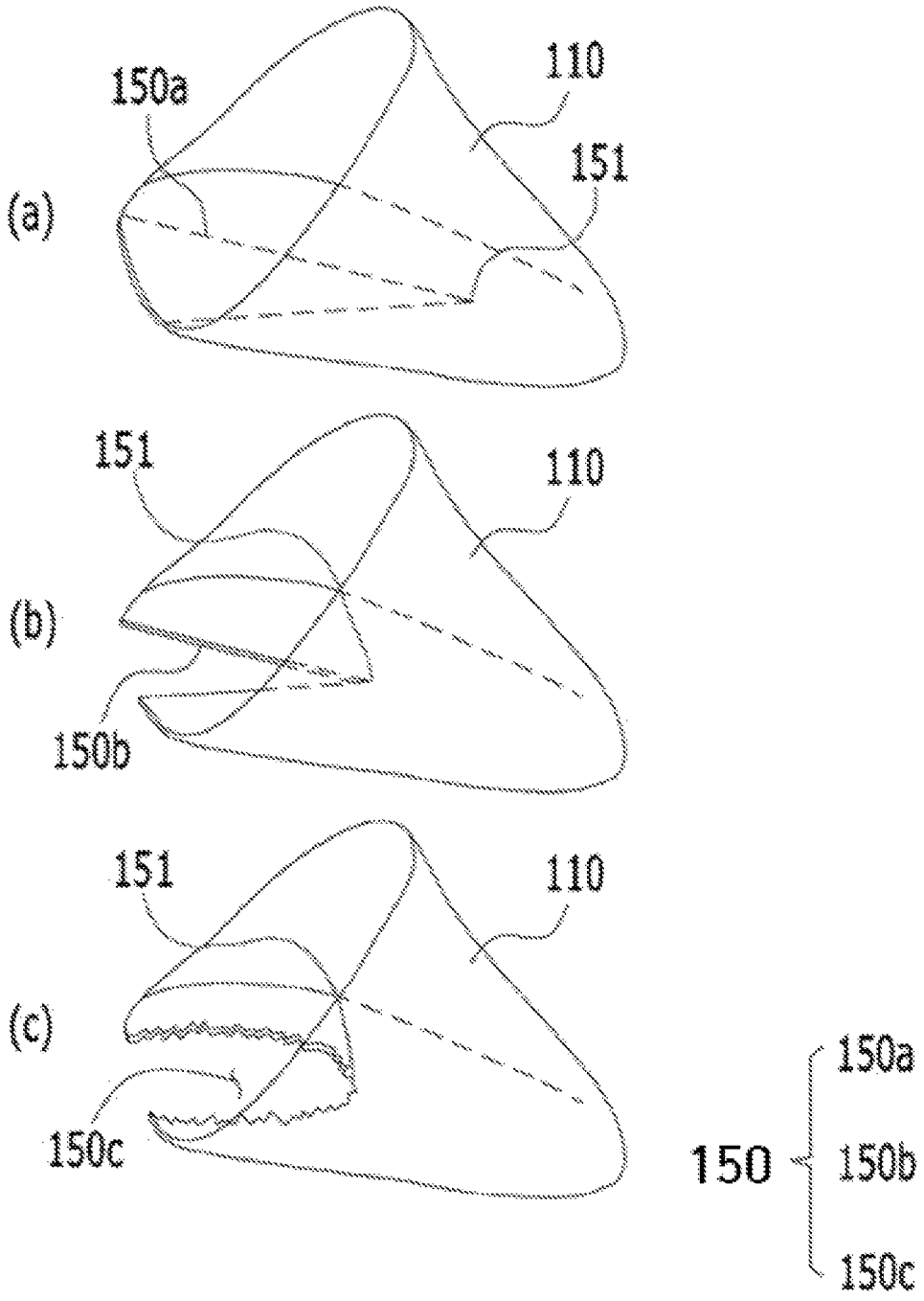
FIG. 3 are perspective views illustrating a front guide member of a flexible shoe for a mannequin according another embodiment of the invention.
Figure 4:
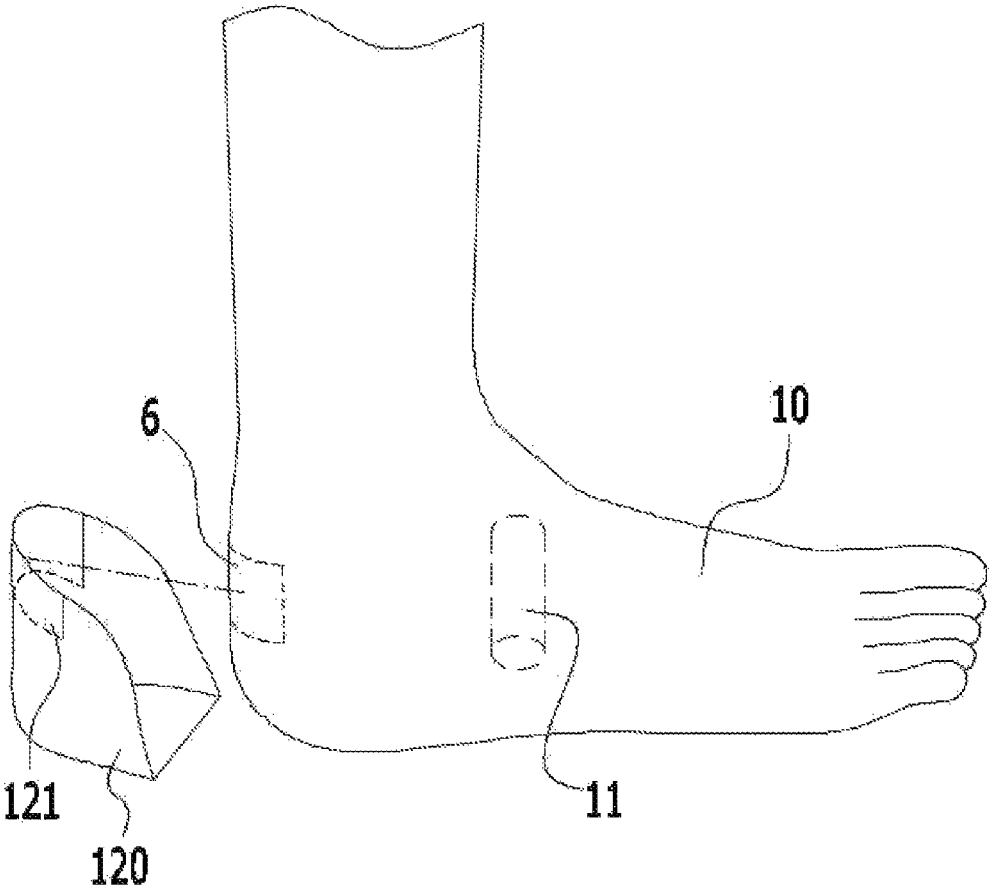
FIG. 4 is a perspective view illustrating a state of fixing the rear guide member of the flexible shoe according one embodiment of the invention to a foot of the mannequin.
Figure 5:
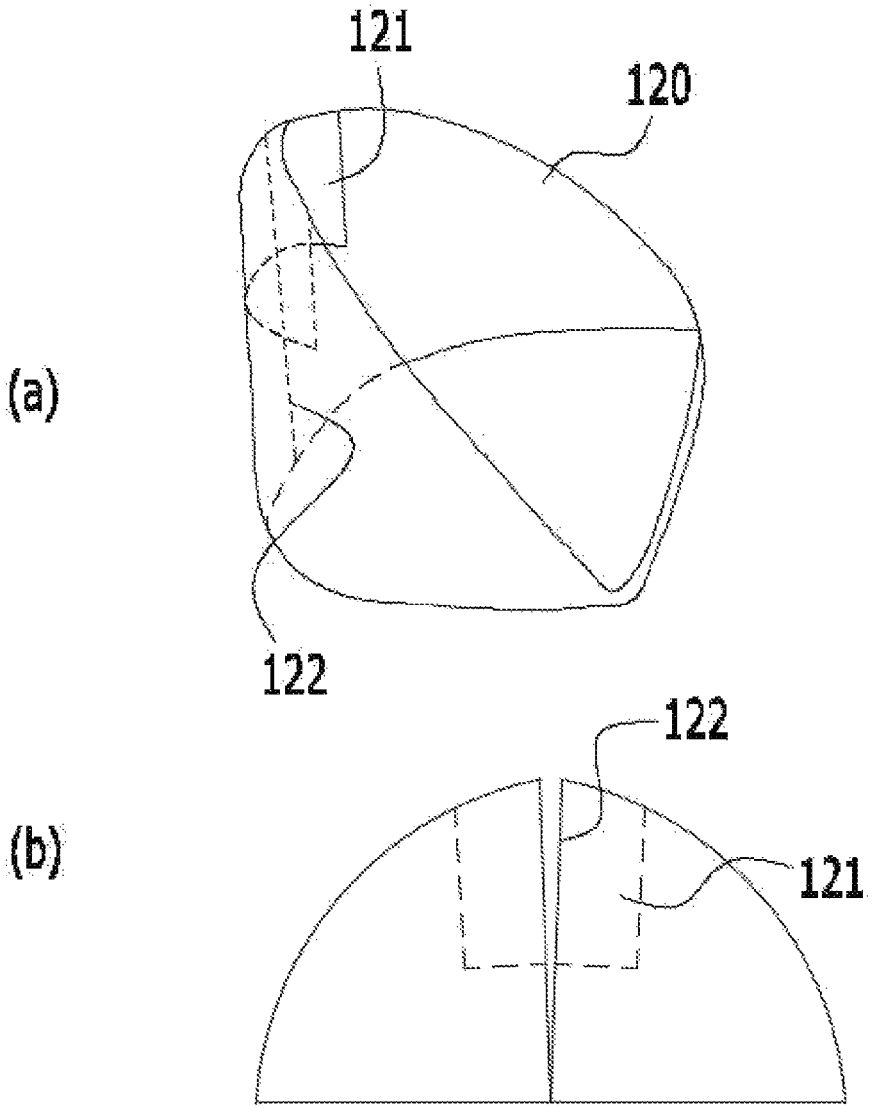
FIG. 5 are a perspective view and a rear view illustrating a rear guide member of a flexible shoe for a mannequin according another embodiment of the invention.
Figure 6:
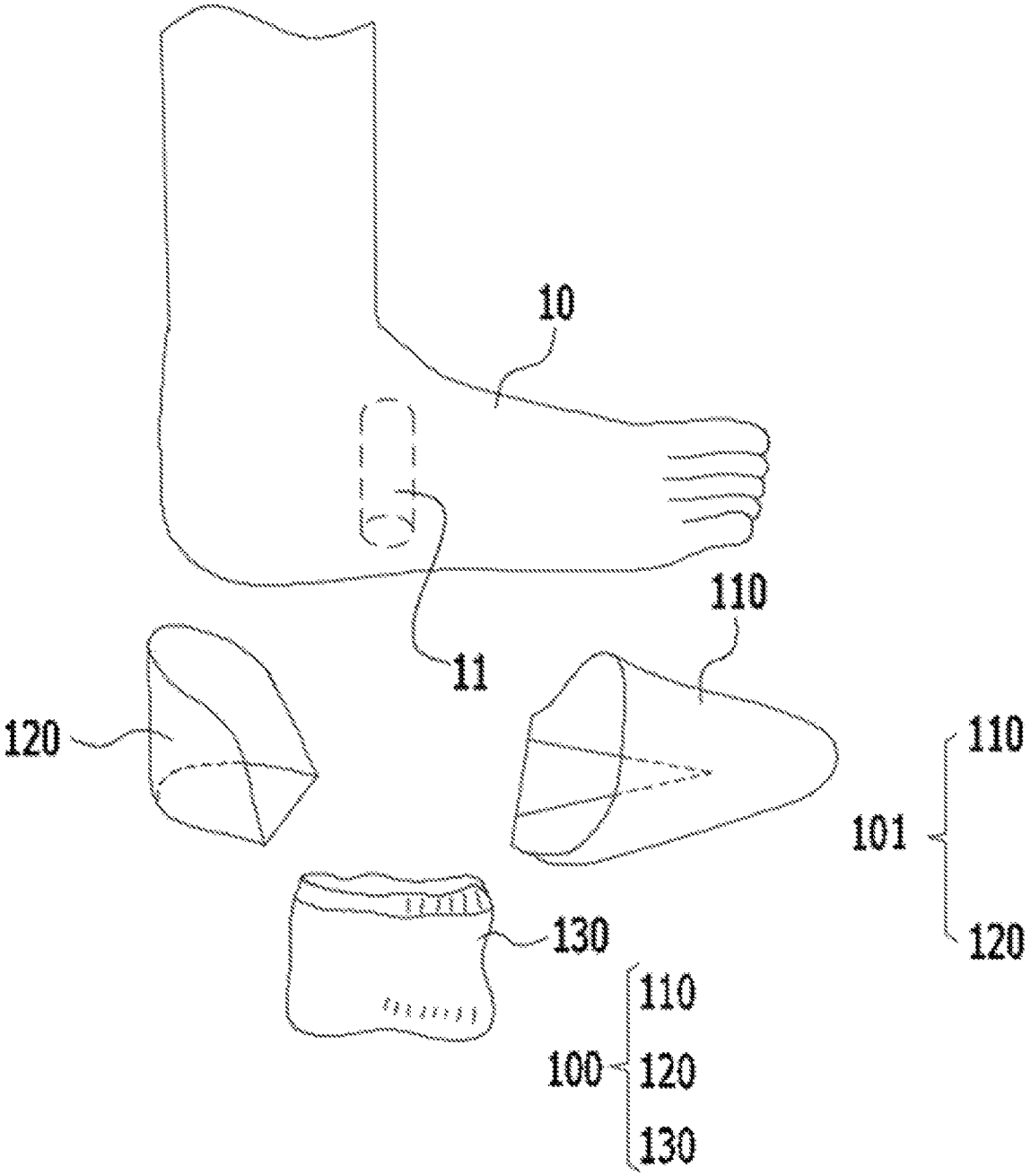
FIG. 6 is a perspective view illustrating a front guide member, a rear guide member, and a cover member of the flexible shoe for the mannequin according one embodiment of the invention.

FIG. 2 are perspective views illustrating a front guide member and a rear guide member of a flexible shoe for a mannequin according one embodiment of the invention. FIG. 3 are perspective views illustrating a front guide member of a flexible shoe for a mannequin according another embodiment of the invention. FIG. 4 is a perspective view illustrating a state of fixing the rear guide member of the flexible shoe according one embodiment of the invention to a foot of the mannequin. FIG. 5 are a perspective view and a rear view illustrating a rear guide member of a flexible shoe for a mannequin according another embodiment of the invention. FIG. 6 is a perspective view illustrating a front guide member, a rear guide member and a cover member of the flexible shoe for the mannequin according one embodiment of the invention.

With reference to the drawings, the term "front" is used to generally describe a direction toward a tow portion, on the basis of FIG. 4, the term "rear" is used to generally describe a direction toward a heel portion, the term "side" is used to generally describe a direction toward both sides of a top of a foot, and the term "lower" is used to generally describe a direction toward a sole.

In the following description, the terms "adhering member" and "attaching member," and the terms "attach," "dispose," "fix" and "add" are appropriately combined in use, but have the substantially same meaning as a detachable member and a separated situation, respectively.

In the following description, a shoe for a mannequin is explained and illustrated as a shoe for a mannequin designed as an adult woman, but the invention is not limited thereto. For example, the shoe for a mannequin according to the invention can be applied to a shoe for a mannequin designed for a man, an infant, a child, a juvenile, an adult and a senior. Also, the shoe for the mannequin may include a shoe for a disabled person, a shoe for a toy robot, a shoe for a smart robot toy, and a shoe for a humanoid robot, in addition to a shoe and a sneaker for a person.

Referring to the drawings, a flexible shoe 100 for a mannequin according to the embodiment includes a guide member 101 having a front guide member 110 and a rear guide member 120 which are designed to have a specific shape, and a cover member 130.

Specifically, the front guide member 110 is configured to receive and cover a toe portion of the mannequin's foot 10, and the rear guide member 120 is configured to receive and cover a heel portion of the mannequin's foot 10. Also, the cover member 130 is configured to cover the mannequin's foot 10 which is inserted into the front guide member 110 and the rear guide member 120. Specifically, front and rear portions of the cover member 130 are respectively supported by the front guide member 110 and the rear guide member 120, and the cover member 130 is attached to the front guide member 110 and the rear guide member 120 which are expanded or retracted to receive the mannequin's foot 10 therein. When seen from the outside, the cover member 130 forms the shape of the front guide member 110 and the rear guide member 120 which receive the mannequin's foot 10 therein. The flexible shoe 100 for the mannequin according to this embodiment is designed to be seen as a silhouette of a general shoe, a flat shoe or a comfortable sneaker.

The front guide member 110 consists of upper and lower portions which are integrally formed and can be extended or deformed to cover the toe portion. The rear guide member 120 consists of lateral and lower portions which are integrally formed and can be extended or shortened to cover the heel portions, without being separated from the lateral and lower portions.

The front guide member 110 and the rear guide member 120 may be made of plastic, silicon, pulp, paper, paper mache, or Hanji (Korean traditional paper).

More specifically, the front guide member 110 and the rear guide member 120 may be made of one of plastic materials, silicone materials, Hanji (Korean traditional paper) paste materials, paper materials, fabric materials, and non-woven fabric materials, or a combination thereof.

The plastic materials includes PET/PETE, HDPE, PVC, LDPE, PP, PS and PES, and the silicone materials includes silicone rubber used for molding, high tear strength silicon rubber, flame retardant silicon rubber, and super heat-resistant silicon rubber. The Hanji (Korean traditional paper) paste includes a Hanji paste and a paper mache paste which are a gel state before paper is formed. In addition to the plastic material, the silicon material, and the Hanji (Korean traditional paper) paste, the shoe for the mannequin may be made of paper materials including Hanji (Korean traditional paper), paper mache, pulp paper, window paper, vellum paper, newspaper fabric, and secondary grade paper, fabric materials woven or knitted by natural fiber, chemical fiber or semi-synthetic fiber, a non-woven material, or a combination thereof.

A method of manufacturing the front guide member 110 and the rear guide member 120 by use of the above-described materials will be described later in conjunction with the method for manufacturing the flexible shoe for the mannequin.

The front guide member 110 according to this embodiment may have circumferential adjusting structures 150*a*, 150*b*, and 150, as illustrated in FIGS. 3(*a*)-3(*c*). The circumferential adjusting structure may be formed on a top surface or a bottom surface of the front guide member 110. The circumferential adjusting structure is to adjust a circumference of the front guide member 110 along a front circumference of the mannequin's foot.

As illustrated in FIG. 3(*a*) which shows one embodiment of the circumferential adjusting structure 150, the bottom surface of the front guide member 110 may be provided with a placket mark 150*a*. The placket mark 150*a* is cut along a cutting line by scissors or a knife, and is opened or closed on the basis of the cutting line so that a size can be adjusted according to the front portion of the mannequin's foot 10.

As another embodiment illustrated in FIG. 23(*b*), an adjusting range of the circumferential adjusting structure is determined by the circumference of the mannequin's foot. If the circumference of the mannequin's foot is large and thus the adjusting range becomes larger along one side of the front guide member 110, the placket line is formed to be longer to form a structure 150*b* which is cut by a desired depth. As illustrated in FIG. 3(*c*), the circumferential adjusting structure has a round structure 150*c* which is recessed by a desired depth along one side.

Preferably, a start point 151 of the placket mark or the round placket, which is formed at the front guide member 110 is set to maintain the specific shape of the front toe portion.

The toe space is maintained by the shape of the front toe portion. The sharp shape of the front toe portion maintains the sharp toe space, while the round shape maintains the round toe space. Since the shape of the foot 10 is not symmetric on the basis of a center line from the center of the front toe to an end point of the heel through the top of the foot when the front portion of the mannequin's foot 10 is inserted into the front guide member 110, the start point 151 of the placket or round structures 150*a*, 150*b* or 150*c* is formed in such a way that the outside is wider than the inside in view of the toe space.

As illustrated in FIG. 4, the rear guide member 120 according to this embodiment is stably fixed to the heel of the mannequin's foot 10 by attaching members 6 and 121 and an inner upper portion of the rear guide member 120, to prevent the rear guide member 120 from being detached from the heel, and the rear guide member 120 is also supported by the cover member 130 covering the rear guide member 120.

More specifically, the rear guide member 120 is fixed at a proper position of the heel of the mannequin's foot by the attaching members 6 and 121 which are provided to the heel of the mannequin's foot 10.

The attaching member includes an adhesive, a double-sided tape, VELCRO®, i.e. a hook and loop surface fastener, a hook-type binder, a button-type binder, and a magnet.

The attaching member may be any one selected from various attaching means. The adhesive includes liquid spray for temporary fixation and a solid paste for temporary fixation. The double-sided tape is one used for temporary fixation. The magnet includes magnetic substances. Also, even though a mounting position of the attaching member is varied, any one of the attaching members may be selected and mounted. In addition, it means the mounting of the attaching member unless otherwise noted.

In some cases, the inside of the rear guide member 120 may be provided with the attaching member, or may be coated by frictional materials to prevent the slippage, such as silicone.

As illustrated in FIG. 5, the rear guide member 120 according to this embodiment is provided with a cutting line so that the mannequin's foot 10 is suitable for a high-heeled shoe, and the rear guide member 120 can be used regardless of the height by cutting it along the cutting line 122. More specifically, if there is no cutting line 122, as the heel of the mannequin's foot is away from a floor, the rear guide member 120 does not match with the heel of the mannequin's foot, so that a space is formed inside the lower portion of the back. Accordingly, in order to cover the heel by the rear guide member 120, without forming the space, as illustrated in FIG. 5, the back is cut along the cutting line 122, so that the rear guide member 120 is not separated from the heel, but is properly attached to the heel, even though the height of the heel is varied. If necessary, as illustrated in FIG. 5, the cut portion in which the cutting line 122 is formed can be fixed to the heel of the mannequin's foot by attaching the above-described attaching member 121 to the upper portion of the cutting line 122.

More specifically, the rear guide member 120 has the cutting line to adjust the unnecessary space generated when the rear guide member 120 is disposed on the heel. Accordingly, the rear guide member 120 can be attached to the heel of the mannequin's foot so that the rear guide member 120 is not separated from the heel to prevent formation of the unnecessary space.

Figure 7:
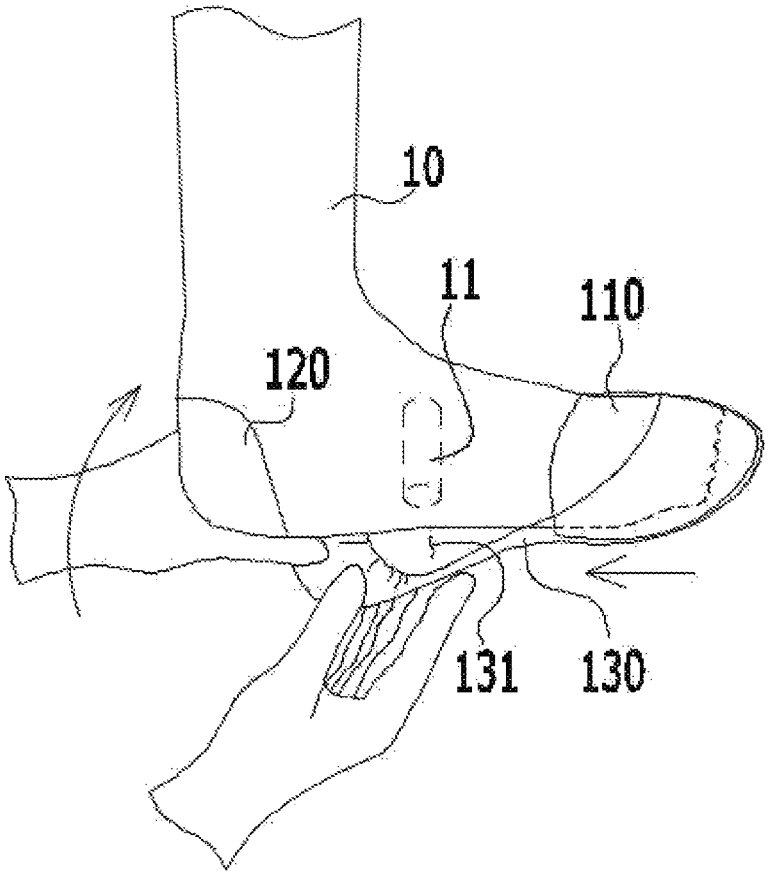
FIG. 7 is a perspective view illustrating a state of putting the flexible shoe for the mannequin according one embodiment of the invention on a foot of the mannequin.

FIG. 6 is a perspective view illustrating the front guide member 110, the rear guide member 120 and the cover member 130 of the flexible shoe 100 for the mannequin according one embodiment of the invention. FIG. 7 is a perspective view illustrating a state of putting the flexible shoe for the mannequin according one embodiment of the invention on the mannequin's foot 10.

Referring to FIGS. 6 and 7, the cover member 130 according to this embodiment has an opening 131 formed on an upper portion to receive the mannequin's foot 10. The cover member 130 is preferably made of a fabric including elastic threads and yarns, such as spandex, so that the cover member 130 is stretched when the cover member 130 is mounted on the mannequin's foot through the opening 131. The fabric including the elastic threads and yarns may use a fabric or knitted texture, and is stretched according to the shape of the guide member 101 mounted on the mannequin's foot 10, the length of the mannequin's foot, and the height of the heel to have the same shape as that of the guide member 101 which is mounted on the mannequin's foot 10.

Figure 9:
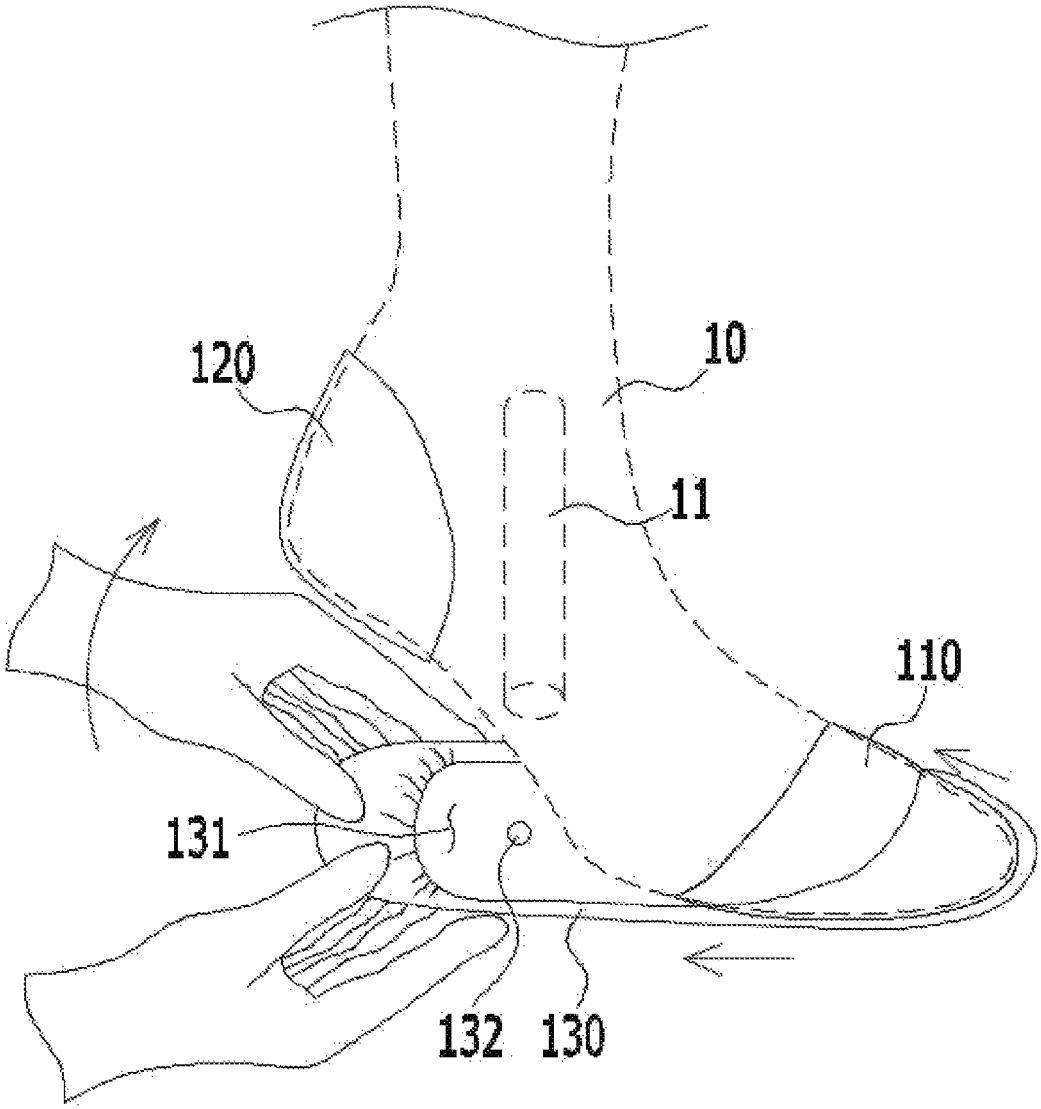
FIG. 9 is a perspective view illustrating a state of putting the flexible shoe for the mannequin according one embodiment of the invention on a foot of the mannequin.
Figure 11:
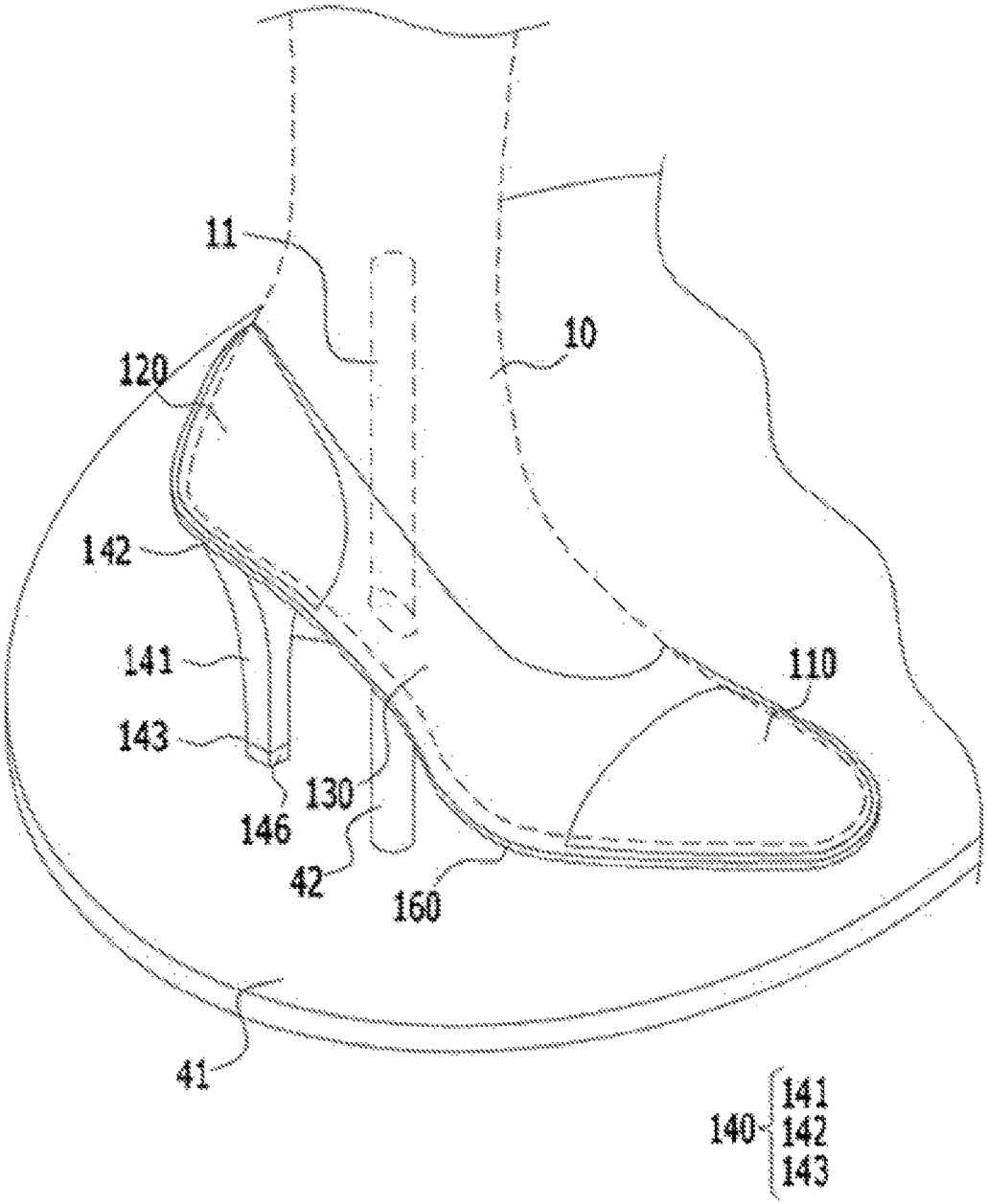
FIG. 11 is a perspective view illustrating a state that the foot of the mannequin wearing the flexible shoe for the mannequin according one embodiment of the invention is mounted on a base.

As illustrated in FIGS. 9 and 11, a bottom surface of the cover member 130 may be provided with a through-hole 132 to receive a support 42 which is inserted into the mannequin's foot 10.

As illustrated in FIG. 7, the cover member 130 is configured to cover the front guide member 110 which receives the toe portion of the mannequin's foot 10, and the rear guide member 120 which receives the heel portion, by elastically pulling it. The cover member 130 is preferably formed in the shape of a sock or an outer sock.

If the cover member 130 of an overshoe shape is mounted on the members, the flexible shoe 100 according to the invention may form a shoe, but if the cover member 130 of a long sock shape is mounted, the flexible shoe 100 may form a boot.

Since the cover member 130 of the sock shape can cover from an ankle of the mannequin's foot to a calf, a shoe of a boot shape can be easily manufactured by use of the flexible shoe 100 according to the invention.

Instead of providing the flexible shoe 100 for the mannequin with a shoelace and holes, sewing the stich on the shoe 100, or attaching an engaging accessory, such as a buckle, since the outer surface of the elastic cover member 130 is provided with a pattern of a shoelace, a stitch, or an engaged accessory, a process of manufacturing the flexible shoe 100 for the mannequin can be simplified.

In this instance, as one example of forming the pattern on the outer surface of the cover member 130, the pattern may be formed by use of any one selected from weaving or knitting, or transfer printing, silkscreen printing, stencil printing, offset printing, solvent printing, UV printing, hologram printing, 3D lenticular printing, or a printing method including fluorescence, phosphorescence, light emitting, gold leaf, and silver leaf.

The pattern may be a decorative pattern or a materials-indicating pattern. Also, one or more methods of forming the pattern may be selected.

According to another embodiment of the invention, if the elastic cover member 130 is overlapped with one or more layers, the cover member can easily form a skin of the shoe, without using cutting, sewing and finishing processes, thereby reducing a time and cost required for manufacturing the flexible shoe 100 for the mannequin.

The cover member 130 of the invention can be manufactured by a circular knitting machine, for example. In this instance, a coupling line to be formed on the cover member 130 is preferably positioned on the sole so as not to expose a stitched line to the outside, like socks or outer socks.

In particular, in the case of the cover member 130 formed in the shape of socks, since the stitched line which is the coupling line is generally formed on the top surface of the cover member 130 at manufacturing, the coupling line is outwardly exposed when being put on the mannequin, which deteriorates the sense of shoe or footwear. Therefore, the stitched line is positioned on the lower portion by controlling a program for weaving the cover member 130.

Since the flexible shoe for the mannequin according to the invention includes the front guide member 110 and the rear guide member 120 which are separated from each other, the appearance of the shoe 100 for the mannequin can be formed by covering the elastic cover member 13*p* on the members, irrespective of the length of the mannequin's foot and the height of the heel.

Figure 8:
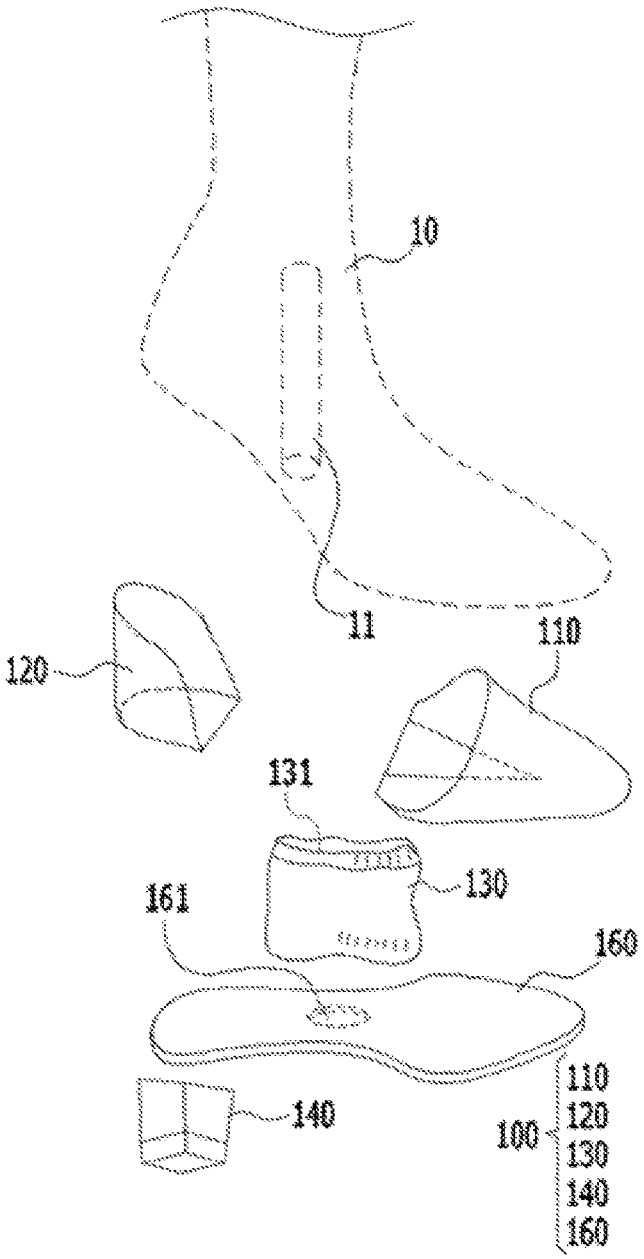
FIG. 8 is a perspective view illustrating a front guide member, a rear guide member, a cover member, a bottom guide member, and a protrusion member of the flexible shoe for the mannequin according one embodiment of the invention.

In the flexible shoe for the mannequin according to another embodiment of the invention, as illustrated in FIG. 8, a bottom surface guide member 160 (i.e., an outer sole) corresponding to the lower portion of the cover member 130 may be provided with the cover member 130 which covers the front guide member 110 and the rear guide member 120 which receive the mannequin's foot 10.

The bottom surface guide member 160 may be used as a protrusion member 140 to cover the entire sole, depending upon the thickness of the bottom surface guide member.

Also, as illustrated in FIG. 8, the flexible shoe 100 for the mannequin according to this embodiment may further include the protrusion member 140 extending downwardly from the lower portion by a given length, if necessary. The protrusion member 140 serves as the heel for supporting the bottom surface of the shoe, and one or more members may be provided. Preferably, the protrusion member 140 according to this embodiment is detachably mounted on the bottom surface of the cover member 130 at the position corresponding to the rear guide member 120.

The configuration for installing the mannequin's foot 10 wearing the flexible shoe 100 to a base 41 will now be described.

As illustrated in FIG. 11, a support 42 is vertically installed to a plane surface of the base 41, and a center of the sole of the mannequin's foot 10 is provided with a support receiving hole 11 formed in the mannequin's foot 10. In order to install the mannequin's foot 10 wearing the flexible shoe 100 to the base 41, the support 42 is inserted into the support receiving hole 11, so that the mannequin having the mannequin's foot 10 is supported in a standing state. In the case of inserting the support 42 into the support receiving hole 11 formed in the sole of the mannequin's foot, the support 42 passes through the through-hole 132 of the cover member 130, and then is inserted in the support receiving hole 11 to fix the mannequin.

Figure 1:
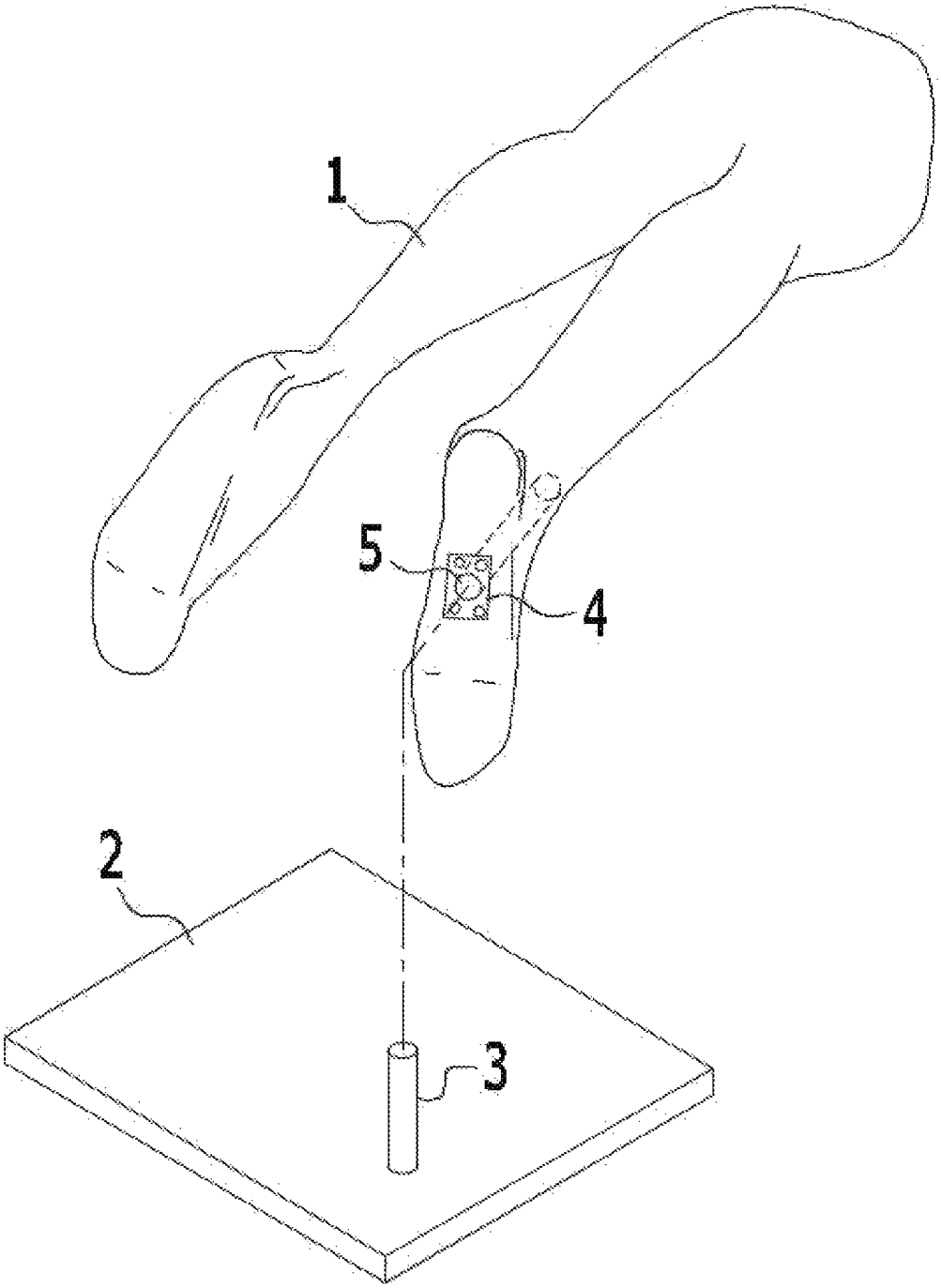
FIG. 1 is a perspective view illustrating a structure for installing a conventional mannequin.

Various forming materials have been recently developed for light and strong mannequins. As illustrated in FIG. 1, the mannequin's foot 10 of the related art has a coupling pipe 5 fixed to a bracket 4, but the mannequin's foot 10 of this embodiment is provided the support receiving hole 11 formed at the position of the coupling pipe 5.

One foot of the mannequin is configured to receive the support 42, while the outer foot may not be provided with a hole to receive the support. Also, the through-hole 132 is not only formed in the sole of the mannequin's foot 10, but also is formed in a calf, a thigh, or a flip according to the position of the support 42. Therefore, the front guide member 110, the rear guide member 120, the cover member 130, the bottom surface guide member 160, or the protrusion member 140 may be provided with the through-hole 132 at various positions corresponding to the position of the support 42.

Figure 12:
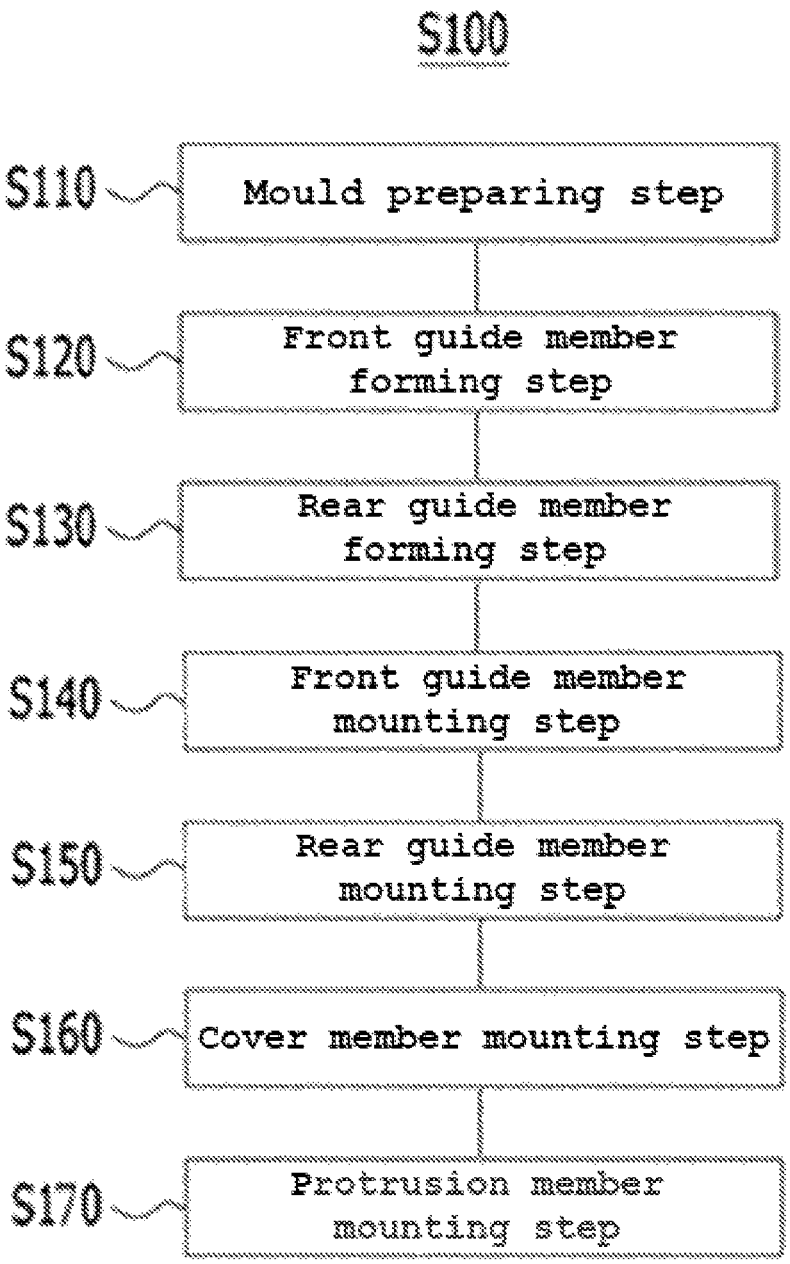
FIG. 12 is a flowchart illustrating a method for manufacturing the flexible shoe for the mannequin according one embodiment of the invention.
Figure 13:
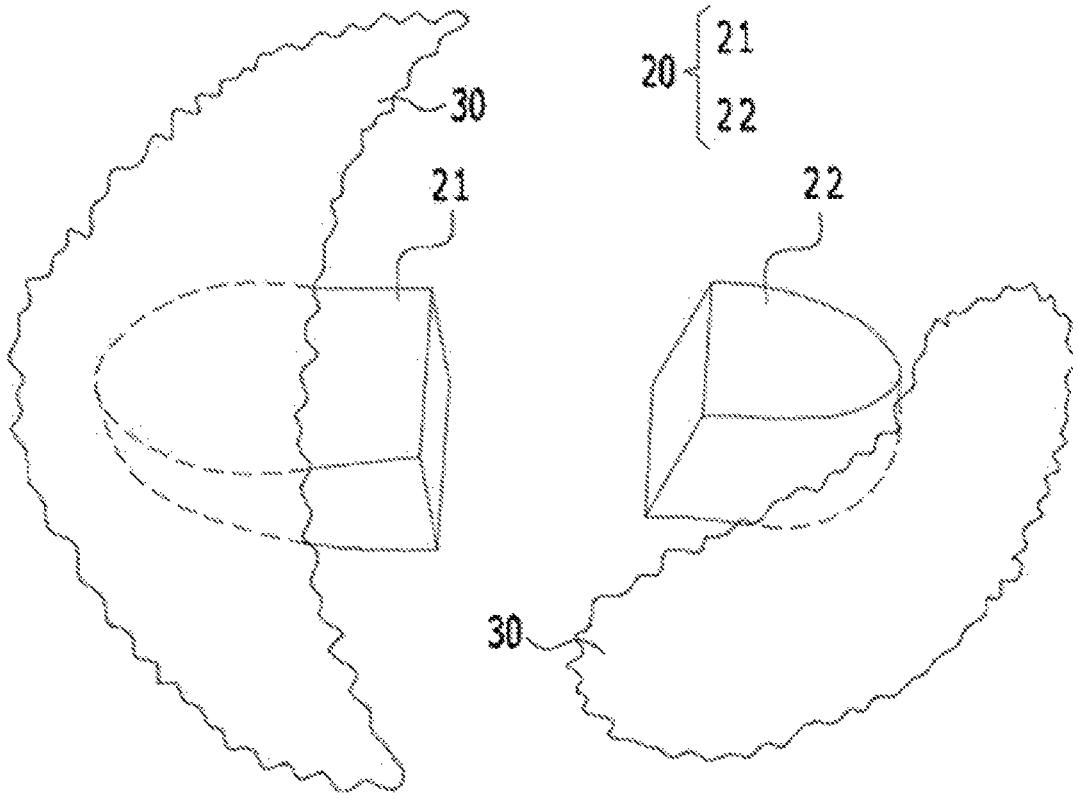
FIG. 13 is a view illustrating a process of forming the front guide member and the rear guide member by a mould.

FIG. 12 is a flowchart illustrating a method S100 for manufacturing the flexible shoe 100 for the mannequin according one embodiment of the invention. FIG. 13 is a view illustrating a process of forming the front guide member 110 and the rear guide member 120 by a mould 20.

Referring to FIGS. 12 and 13, the method S100 for manufacturing the flexible shoe 100 for the mannequin according one embodiment of the invention includes a mould preparing step S110, a front guide member forming step S120, a rear guide member forming step S130, a front guide member mounting step S140, a rear guide member mounting step S150, and a cover member mounting step S160.

Specifically, the mould preparing step S110 is to prepare the mould 20 which is designed in the shape of a shoe according to the size of the mannequin's foot 10.

The mould 20 is manufactured by the same process as a last which is a mould for forming a shoe of a person. After the shape of the mannequin's foot 10 models in clay or plaster, the shape is finished. The mould 20 may be made of wood, plastic, or metal.

Since the mannequin mould 20 has a front forming mold 21 for the front guide member and a rear mould 22 for the rear guide member which are separated from each other, the number of moulds is smaller than that of the conventional shoe mould for a person, and can make the shoes through various combinations of moulds, without regard to sizes of the foot.

As illustrated in FIG. 13, the mould 20 has the uniformly separated parts, but a bottom surface of the mould 20 may be extended along the sole, and may be separated from a side of the heel portion or an upper portion of the toe portion. Or, the mould 20 may be extended from the toe portion to the top of the foot, or the mould 20 may be extended from the heel portion including the top of the foot, but may be separated from the toe portion.

Therefore, in the case of the mannequin's foot, a toy foot, a prosthetic leg of a disabled person, and a robot's foot, the sealed front guide member 110 is formed by the separated mould 20, and then is engaged to a body part of the separated foot of the mannequin, the prosthetic leg, or the robot's foot. The front guide member and the body part are covered by the cover member 130 to provide the shoe with diversity.

For the designed shape of the shoe, the front mould 21 for forming the front guide member 110 including the toe portion can form various shapes of a front toe portion to determine the shape of the shoe. The shape of the front toe portion includes at least one selected from a group including a sharp shape for considering a space of the front toe portion, a round shape, a rectangular shape, and an oval shape.

The rear mould 22 forms the rear guide member 120 in view of a slope of a lateral surface and a bottom surface according to the height of the heel portion of the foot 10. The center portion of the lateral surface of the heel portion may be made by selecting a heel curve which exerts an effect on the appearance of the shoe, or a smooth straight line, such as a sneaker. The bottom surface of the rear mould 22 is preferably sized in view of a width and length of a heel seat to which the protrusion member 140 is attached.

As illustrated in FIG. 13, the mould may be manufactured to have a three-dimensional appearance, may be manufactured to have a hollow portion, of which forming materials is filled in the hollow mould, or may be manufactured to accommodate liquified plastic or silicone fluid therein.

It should be noted that the front guide member forming step S120 and the rear guide member forming step S130 which will be described hereinafter are not devised for mass production, but are manually carried out to manufacture a sample shape of the shoe for the mannequin. Also, the shoe is manufactured by selecting the Hanji (Korean traditional paper) among the forming materials, but the shoe may be manufactured by use of other forming materials, i.e., at least one of plastic, silicone, paper, fabric, and non-woven fabric.

As one example of the front guide member forming step S120 and the rear guide member forming step S130, a step of forming the members by use of the Hanji (Korean traditional paper) will now be described in detail. As illustrated in FIG. 13, a forming material 30 may be placed over the front mould 21 and then be dried. Otherwise, the forming material 30 may be placed over the front mould 21 while applying the pressure to the forming materials, and then be dried, or after the pressure is applied to the forming materials, the forming materials is dried and formed, and then is separated from the front mould 21 to form the front guide member 110. Also, the rear guide member 130 can be manufactured by the same process as that of the front guide member 120.

The rigidity of the guide member 101 can be increased by repeating a process of attaching the Hanji (Korean traditional paper) 30, which is three-dimensionally cut, to the mould 20, on which an edge line of the guide member 101 to be made is drawn, and then drying the Hanji (Korean traditional paper).

In the case of making the front portion of the front guide member 110 very sharp, in the case of accurately representing a characteristic shape, when the cover member is mounted, by strongly maintaining a characteristic design shape of the protruding portion, or in the case of strongly maintaining the rear guide member 120 to easily attach or detach the protrusion member, when the rear guide member 120 is made, many layers of Hanji (Korean traditional paper) can be placed over the portion which is additionally wanted.

When the torn Hanji (Korean traditional paper) 30 is attached to the wanted portion, a natural glue, such as a gel made of rice and flour, or a synthetic glue is applied to the Hanji (Korean traditional paper), and then is aged to increase elasticity and flexibility. The Hanji (Korean traditional paper) is softly pulled, and then is placed over the surface of the mould to naturally represent the curved surface of the guide member through drying. After that, the edge of the guide member is polished or finished.

The front guide member forming step S120 includes a process of forming the circumferential adjusting structure 150 to adjust the circumference of the front guide member 110, on the top surface or the bottom surface of the front guide member 110.

The circumferential adjusting structure 150 shown in FIG. 3 includes a structure (FIG. 3(*a*)) in which the placket mark 150*a* is marked on the finished front guide member 110 shown in FIG. 2, and a structure (FIG. 3(*b*)) in which the partial cutting line 150*b* is formed along the placket mark. The front guide member 110 shown in FIG. 3(*c*) has a simple structure in which the torn Hanji (Korean traditional paper) is placed on the upper portion and extends to a portion of the lower portion in the process of forming the front guide member 110.

After samples of the front guide member 110 and the rear guide member 120 are manufactured, the placket mark 150*a* is inputted in a computer for mass production, so that a machine can automatically draw the placket mark, and a cutter forms the packet portion 150*b*. The round placket portion 150*c* is simply formed by covering one sheet of Hanji (Korean traditional paper) 20 on the mould 20 or applying the pressure to the mould filled with the Hanji (Korean traditional paper), through a manufacturing method using characteristics of paper.

At the front guide member forming step S120 and the rear guide member forming step S130, the forming materials can be used by selecting at least one of plastic, silicone, Hanji (Korean traditional paper) paste, fabric, knit, and non-woven fabric. Also, since the front guide member 110 and the rear guide member 120 are positioned inside the cover member 130, recycled secondary grade paper can be used together with synthetic materials to harden the members.

Hanji (Korean traditional paper) or Hanji (Korean traditional paper) paste is more preferably as the Hanji (Korean traditional paper) materials. The Hanji (Korean traditional paper) is made of a paper mache paste of paper mulberry or cedar, and is referred to as Hanji in China or Hwaji in Japan. Since the Hanji (Korean traditional paper) is light and high durability, it is not only used as preservation paper for conserving works of art, but also is used as paper for calligraphy, furniture, accessories, dishes, wall paper, floor paper, ceiling paper, and window paper. Also, since the Hanji (Korean traditional paper) is mixed with other barks and leaves of other trees or grasses, its application is very wide. The Hanji (Korean traditional paper) is utilized in cooperation with pulp or other materials to reduce a cost and increase diversity thereof.

The front guide member 110 is configured to cover the toes of the mannequin's foot 10, and may have an integral shape from the upper portion of the toes to a lower portion of the toes. The shape of the front guide member 110 is determined by various shapes of the mould 21. The upper portion of the front guide member 110 may be formed in various shapes to cover the top of the foot or be deeply dent according to the shape of the shoe.

The rear guide member 120 is configured to cover the heel portion of the mannequin's foot 10, and may have an integral shape from the lateral portion of the heel to the lower portion of the heel.

The rear guide member 120 is preferably formed in the shape of a sector, for example, a counter.

Since the rear guide member 120 has the lateral portion and the lower portion which are integrally formed, the cutting line 122 is not positioned on the lateral portion, but is formed on the lower portion, thereby adjusting the space caused by irregularity of the heel portion when the mannequin's foot 10 is inserted. The lateral side of the rear guide member 120 may be attached by an anti-skid member, such as silicone, to serve as a heel gripper. After the rear guide member 120 is formed with the cutting line 122, the attaching member 121 can be adhered. Or, after the attaching member 121 is attached, the cutting line 122 may be formed.

The Hanji (Korean traditional paper) 30 is attached to the bottom surface of the rear guide member 120 to form the protrusion member which is formed integrally with the rear guide member.

Next, the front guide member mounting step S140 and the rear guide member mounting step S150 are carried out. Specifically, the front guide member mounting step S140 is mounting the formed front guide member on the mannequin's foot 10, and the rear guide member mounting step S150 is mounting the formed rear guide member 120 on the rear guide member mounting step S150.

In general, the Hanji (Korean traditional paper) 30 is placed over the surface of the shoe mould 20 which is formed according to the size and height of the mannequin's foot 10. The mannequin's foot 10 is inserted into the front guide member 110 shown in FIG. 2, without adjusting the height at the mounting step, and then the heel of the foot is inserted into and fixed to the rear guide member 120 with the adhesive 121 attached on the inner upper portion thereof.

The adhesive is a temporary fixing adhesive, and can be re-utilized for the rear guide member 120.

Also, the front guide member 110 and rear guide member 120 are cut along the placket mark 150*a* or the cutting line 122 which are marked on the members, so as to mount the members on the mannequin's foot 10 of a new type.

If there is a difference between the front guide member 110 and the front portion of the new mannequin's foot, the circumferential adjusting structure is utilized. As illustrated in FIG. 2, in the case of cutting the placket mark 150*a*, in the case of having the placket portion 150*b*, and in the case of having the round structure 150*c*, the front guide member is adjusted by widening or closing the placket according to the new mannequin's foot, and then is fixed thereto by the adhesive.

In this instance, the length 150*a* or 150*b* and the recessed depth 150*c* of the placket mark of the front guide member are adjusted according to the front portion of the new mannequin's foot. As the spacing between the front portion of the new mannequin's foot 10 and the front guide member 110 becomes larger, the depth can be adjusted by extending the placket or tearing the recessed portion by hands.

In the case of adjusting the space formed on the inner bottom surface of the rear guide member 120 due to the large height difference between the heel of the new mannequin's foot and the rear guide member, the rear guide member 120 is cut along the cutting line 122 marked on the member, and then is attached to the heel of the mannequin's foot by the adhesive which is attached to the rear center.

Although the lateral portion can be completely cut from an upper end to a lower end along the cutting line 122, the lateral portion may be cut from a portion just above a protruding portion of a heel bone.

The cutting line formed on the lateral portion may be formed on the lower portion. In order to remove the unnecessary space caused by the difference between the rear guide member 120 and the heel of the mannequin's foot 10, the heel of the mannequin's foot 10 is disposed on the rear guide member 120, and then the center of the heel is covered by the lower portion which is cut along the cutting line 122. After that, the rear guide member 122 is attached to the heel by any one of the attaching members 121.

The cover member mounting step S160 is to cover the mannequin's foot 10 with the cover member 130 after the rear guide member mounting step S150.

As illustrated in FIG. 7, if the surfaces of the front guide member 110 and the rear guide member 120 which are mounted on the mannequin's foot 10 are covered by the elastic cover member 130, after the opening 131 of the cover member 130 is largely widened, the front guide member 110 mounted on the mannequin's foot 10 is first inserted into the cover member 130. Next, after the cover member 130 is stretched by the hand, the cover member completely covers the rear guide member 120, mounted on the heel, of the mannequin's foot 10. The through-hole 132 formed in the bottom surface of the cover member 130 is aligned with the support receiving hole 11, and then the support 42 is inserted into the support receiving hole 11 to stand up the mannequin 1.

In some cases, a protrusion member mounting step S170 may be carried out after the cover member mounting step S160.

As illustrated in FIGS. 8 and 11, in the case of mounting the protrusion member 140 after cover member mounting step S160, the protrusion member 140 having the same height as the heel is detachably mounted to the bottom surface of the cover member 130 at the position corresponding to the rear guide member 120, and the support 42 is inserted into the support receiving hole 11 through the opening 132 of the cover member 130 to complete the wearing of the shoe.

Alternatively, a step of mounting the bottom surface guide member 160 may be performed after the cover member mounting step S160. The bottom surface guide member 160 comes into contact with the lower portion of the cover member 130 which covers the front guide member 110 and the rear guide member 120 receiving the mannequin's foot. If the thickness of the bottom surface guide member 160 is thin, the support 42 can be smoothly inserted into the support receiving hole 11, without forming the through-hole. By contrast, if the thickness of the bottom surface guide member 160 is thick, the bottom surface of the cover member 130 is provided with the through-hole 161, so that the support 42 is easily inserted into the support receiving hole 11.

In the case of mounting a new protrusion member for a new mannequin having a different height of the heel at the protrusion member mounting step S170, after the mannequin 1 with the flexible shoe 100 is stood up on the base 41, the new protrusion member 140 having the same height as that of the heel of the new mannequin is mounted to the bottom surface of the cover member 130 at the position corresponding to the rear guide member 120, thereby finishing the newly adjusted flexible shoe for the mannequin.

Figure 10:
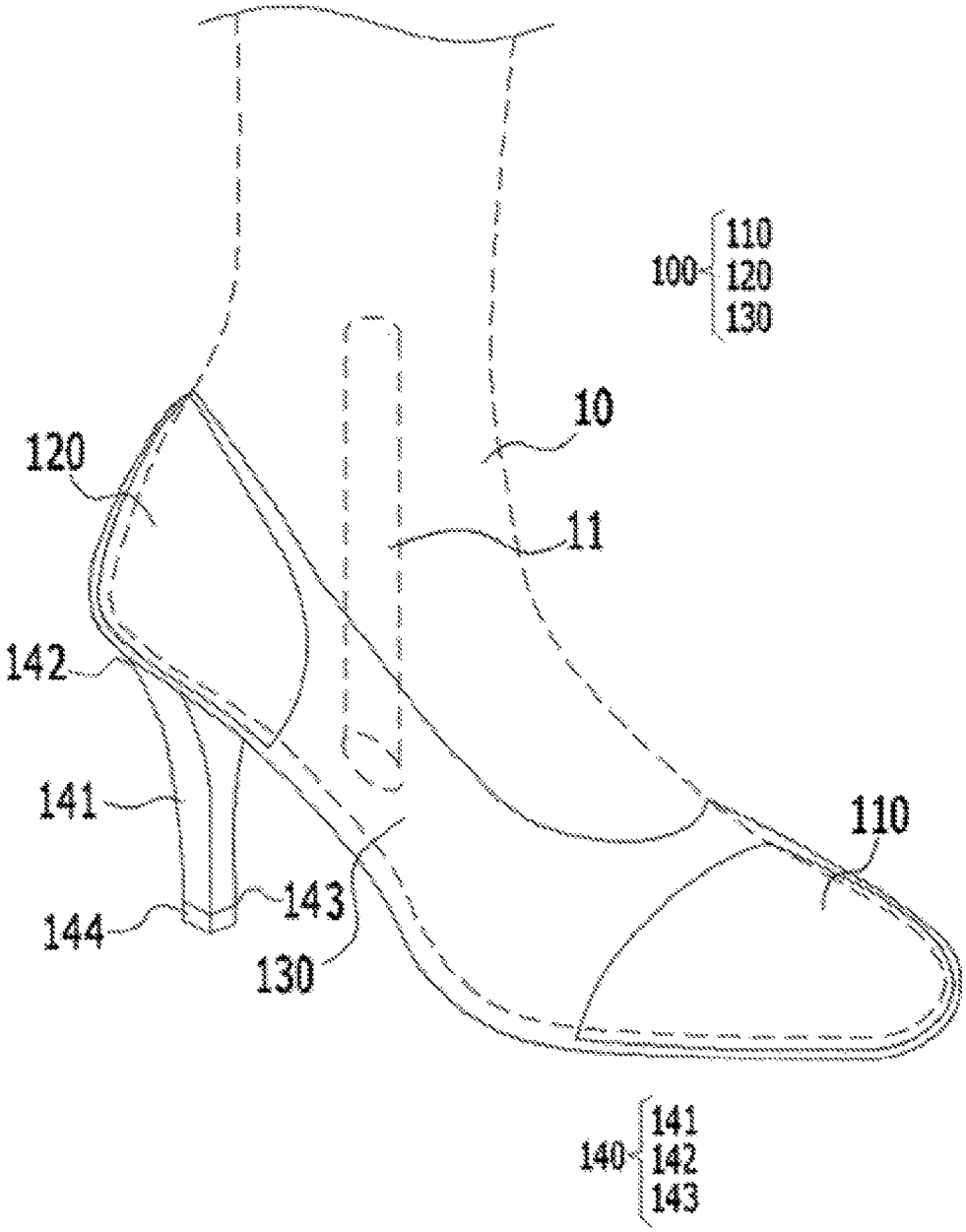
FIG. 10 is a perspective view illustrating a state in which the flexible shoe for the mannequin according one embodiment of the invention is put on a foot of the mannequin.

As illustrated in FIGS. 10 and 11, the protrusion member 140 (i.e., a shoe heel) of the shoe for the mannequin according to this embodiment of the invention has a body portion 141 of a heel shape. The body portion 141 is a hollow structure, and is detachably mounted to the bottom surface of the flexible shoe 100 for the mannequin.

The body portion 141 is formed in the shape of a high heel, but the invention is not limited thereto. The body portion may be formed in the shape of a pumps heel, a platform shoe heel, a wedge heel, or a boot heel according to the shape of the flexible shoe 100 for the mannequin. In the case of the wedge heel, the body portion 141 is a hollow structure, and has a top surface 142 and a bottom surface 143 which are provided with through-holes.

Specifically, the protrusion member 140 may be made of any one of plastic materials, silicone materials, Hanji (Korean traditional paper) paste materials, paper materials, fabric or non-woven fabric materials, or a combination thereof.

The body portion 141 is fixed to the bottom surface of the flexible shoe 100 for the mannequin by applying a thin adhesive to the top surface 142 thereof, or by use of an attaching member including a thick adhesive, a magnet, a hook and loop surface fastener, a hook-type binder, and a button-type binder. Preferably, the body portion is detached by applying a force to the body portion from the outside.

Specifically, the top surface 142 may be attached to the bottom surface of the shoe 100 by a very thin adhesive, for example, a double-sided tape, so as not to form a gap therebetween. In the case of using the magnet as the attaching member, the magnet is fixed to an inner lower portion of the top surface 142 to maintain the top surface in a flat state.

Also, the attaching member can be changed depending on situations. For example, even though the magnet is used as the attaching member for some protrusion members, it can be replaced by a hook and loop surface fastener, a hook-type binder, or a button-type binder according to the shape of the protrusion member 140.

The top surface 142 is fixed to the lower portion of the flexible shoe 100 for the mannequin by the attaching member, and the top surface is preferably detached from the shoe by the external force.

As illustrated in FIG. 10, a top lift 144 may be attached to the lower portion 143 of the protrusion member to protect the heel of the shoe to be worn by a person.

As illustrated in FIG. 11, one of attaching members, such as a magnet 146, is attached to the lower portion 143 of the protrusion member 140, and the attaching member is detachably mounted to the base 41 at the position corresponding to the lower portion 143 of the protrusion member 140.

More specifically, the lower portion 143 of the protrusion member 140 is attached by any one of attaching members, such as a double-sided tape, a hook and loop surface fastener, or a magnet, and the protrusion member can be detachably engaged to the base 41 at the position corresponding to the lower portion of the protrusion member. Also, the height of the protrusion member 140 can be adjusted, and the protrusion member 140 can be positioned under the flexible shoe 100 for the mannequin or a bottom surface guide member 160. Thus, the protrusion member can be seen to be engaged thereto, but is not actually engaged.

The magnet 146 attached to the lower portion 143 of the protrusion member can assist the height of the protrusion member 140 by freely forming the shape of the magnet, and can be attached to or detached from the lower portion under the influence of a magnetic force. A magnet and a steel plate which have opposite polarities are used as the attaching member. As illustrated in FIG. 11, the magnet 146 is attached to the lower portion of the protrusion member, and also is attached to the steel base 41, thereby standing up the protrusion member 140. Therefore, the protrusion member is disposed at a heat seat below the cover member 130. In this instance, the shapes of various attaching members which look like the top lift 144 may be identical to the same shape as the top lift of a general shoe, but may have a different shape. In the case where the base 41 is not made of steel, a magnet or a steel plate having opposite polarity is mounted to the power portion of the base 41 so that the lower portion 143 of the protrusion member can be attached to the base 41. By contrast, a steel plate may be attached to the lower portion 143 of the protrusion member.

In the case where the thin attaching member 146, such a double-sided tape, is attached to the lower portion 143 of the protrusion member, only the protrusion member 140 can be seen, and the long protrusion member 140 can be used.

The protrusion member 140 of the invention may be interposed between the lower portion of the shoe 100 put on the mannequin's foot 10 and the top surface of the base 41.

Since the load of the mannequin 1 is supported by the toe portion of the mannequin's foot 10 and the support 42 of the base 41, the raised heel portion of the mannequin does not need to support the load of the mannequin. Therefore, in the case of a man's heel, of which the lower portion 143 of the protrusion member has a stable shape, or a straight boot heel, the protrusion member 140 can be interposed between the top surface of the base 41 and the lower portion of the flexible shoe 100 for the mannequin, without using the attaching member.

In the case of the other shoe, the upper portion 142 of the protrusion member is attached by the attaching member to detachably mount to the lower portion of the shoe 100, thereby finishing the mounting of the protrusion member 140 which is the heel of the flexible shoe 100 for the mannequin. Also, in the case where the attaching member serves as the top lift 144, the same attaching member should be mounted to the other shoe so that the other shoe seems to the same that of the one shoe, thereby finishing the flexible shoe 100 for the mannequin.

In some cases, before the cover member mounting step S160, the outer surface of the elastic cover member 130 may be provided with a pattern of a tied shoelace, a sewn stitch, or an engaged accessory. It is possible to reduce a manufacturing process and cost of the flexible shoe for the mannequin by forming various patterns of accessories on the outer surface of the cover member 130.

As described above, the flexible shoe for the mannequin shown in FIG. 12 can be manufactured by the method for manufacturing the sample, but the forming steps and the mounting steps can be simultaneously depending upon situations of forming materials and moulds, or the orders of the steps can be changed.

More specifically, the front guide member forming step S120 and the rear guide member forming step S130 can be successively carried out after the mould preparing step S110, but the rear guide member forming step S130 may be performed before or at the same time of the front guide member forming step S120. Also, after the front guide member mounting step S140, the rear guide member mounting step S150 and the cover member mounting step S160 can be simultaneously carried out. Also, the rear guide member mounting step S150 and the cover member mounting step S160 can be simultaneously applied to the mannequin's foot 10. The front guide member mounting step S140 and the cover member mounting step S160 can be simultaneously applied to the mannequin's foot 10. At the mould preparing step S110, the protrusion member 140 can be disposed by use of the protrusion member mounting step S170 to adjust the width, length, and slope of the rear mould 22. The above steps can be sequentially performed, but since all components are separated, the steps may be flexibly carried out.

As described above, according to the flexible shoe for the mannequin and the manufacturing method thereof, it can provide the practical effect of being seen as the actual shoe from the outside. Also, the flexible shoe can be put on the new mannequin's foot by adjusting the guide member and the cover member. In addition, it is possible to reduce costs for manufacturing the shoe which is frequently replaced according to weather or trend, and to shorten a time for replacing the shoe.

The above embodiments are provided to easily understand the invention, and are not intended to limit the invention. The invention may be varied or modified without departing from the spirit or scope defined by the appended claims. Of course, equivalents thereof are contained in the invention.

In other words, although the invention has been described with reference to the particular illustrative embodiments, it is not to be restricted by the embodiments but only by the appended claims. It is to be appreciated that those skilled in the art can change or modify the embodiments without departing from the scope and spirit of the invention.

INDUSTRIAL APPLICABILITY

Since the flexible shoe for the mannequin can provides a practical effect of being seen as an actual shoe from the outside, reduce costs for manufacturing the shoe which is frequently replaced according to weather or trend, and shorten a time for replacing the shoe, the invention can be widely applied to fields of fashion industry.

What is claimed is:

1. A flexible shoe for a mannequin, comprising:

a front guide member (110) configured to receive and cover an entire toe portion of a mannequin's foot (10);

a rear guide member (120) configured to receive and cover a heel portion of the mannequin's foot (10); and a cover member (130) configured to cover the mannequin's foot (10) which is inserted onto the front guide member (110) and the rear guide member (120), wherein:

the front guide member (110), the rear guide member (120), and the cover member (130) are separate members;

the cover member (130) wraps around the front guide member (110) and the rear guide member (120) such that the cover member (130), the front guide member (110), and the rear guide member (120) together form a sole that is configured to be directly in contact with a sole of the mannequin's foot; and a circumferential adjusting structure (150) is formed on a top surface or a bottom surface of the front guide member (110) to adjust a circumference of the front guide member (110), thereby enabling the flexible shoe to be applicable to various foot sizes.

2. The flexible shoe for the mannequin according to claim 1, wherein the front guide member (110) and the rear guide member (120) are made of one of plastic materials, silicone materials, Hanji Korean traditional paper paste materials, paper materials, fabric materials, and non-woven fabric materials, or a combination thereof.

3. The flexible shoe for the mannequin according to claim 1, wherein the circumferential adjusting structure (150) has a placket mark (150*a*) on the bottom surface of the front guide member (110), a structure (150*b*) that is cut by a given length along one side of the front guide member (110), or a structure (150*c*) that is recessed by a given depth along one side of the front guide member (110).

4. The flexible shoe for the mannequin according to claim 1, wherein the rear guide member (120) is adapted to be fixed to a heel portion of the mannequin's foot (10) and a portion corresponding to the heel portion by an attaching member (6 or 121).

5. The flexible shoe for the mannequin according to claim 1, wherein the cover member (130) is made of materials having a given elastic restoring force so that the cover member is elastically deformed according to shapes of the front guide member (110), the rear guide member (120), and the mannequin's foot.

6. The flexible shoe for the mannequin according to claim 5, wherein an upper portion of the cover member (130) is opened to form an opening (131) that is configured to receive the mannequin's foot (10).

7. The flexible shoe for the mannequin according to claim 5, wherein a bottom surface of the cover member (130) is provided with a through-hole (132) that is configured to receive a support for supporting the mannequin therethrough.

8. The flexible shoe for the mannequin according to claim 5, wherein the cover member (130) includes a coupling line formed on a bottom surface thereof.

9. The flexible shoe for the mannequin according to claim 5, wherein a surface of the cover member (130) is provided with a pattern indicating presence of a sewn stitch or accessory.

10. The flexible shoe for the mannequin according to claim 1, wherein an upper portion of the cover member (130) is opened to form an opening (131) that is configured to receive the mannequin's foot (10).

11. The flexible shoe for the mannequin according to claim 1, wherein a bottom surface of the cover member (130) is provided with a through-hole (132) that is configured to receive a support for supporting the mannequin therethrough.

12. The flexible shoe for the mannequin according to claim 1, wherein the cover member (130) includes a coupling line formed on a bottom surface thereof.

13. The flexible shoe for the mannequin according to claim 1, wherein a surface of the cover member (130) is provided with a pattern indicating presence of a sewn stitch or accessory.

* * * * *